US005381593A

United States Patent [19]

Bloch

[11] Patent Number: 5,381,593

[45] Date of Patent: Jan. 17, 1995

[54] APPARATUS FOR SIZING WARPS MADE OF TEXTILE THREADS

[75] Inventor: Joachim Bloch, Schopfheim, Germany

[73] Assignee: Chimitex Cellchemie GmbH, Schopfheim, Germany

[21] Appl. No.: 144,414

[22] Filed: Aug. 30, 1993

Related U.S. Application Data

[62] Division of Ser. No. 891,899, Jun. 1, 1992, abandoned.

[30] Foreign Application Priority Data

Jun. 1, 1991 [DE] Germany ..... 4118076
Feb. 24, 1992 [DE] Germany ..... 4205515

[51] Int. Cl.[6] ..... D06B 21/00; D06B 1/14; D06B 19/00; D06B 15/08

[52] U.S. Cl. ..... 28/178; 28/179; 118/262; 68/202

[58] Field of Search ..... 28/178, 179, 172.1, 28/182, 183; 118/262; 68/200, 202

[56] References Cited

U.S. PATENT DOCUMENTS

| | | | |
|---|---|---|---|
| 2,343,898 | 3/1944 | Griffin et al. | 8/115.6 |
| 3,650,242 | 3/1972 | Mahoney | 68/202 X |
| 3,666,400 | 5/1972 | Lofton et al. | 8/115.6 |
| 3,811,834 | 5/1974 | Schwemmer et al. | 8/115.6 |
| 4,029,833 | 6/1977 | Kosta | 118/262 X |
| 4,632,850 | 12/1986 | Tillofson | 68/200 X |
| 4,643,124 | 2/1987 | Switall | 118/262 X |
| 4,737,378 | 4/1988 | Narita et al. | 118/262 X |
| 4,756,714 | 7/1988 | Hendrix et al. | 8/115.6 |
| 4,823,730 | 4/1989 | Fleissner | 28/178 X |
| 4,835,198 | 5/1989 | Kohno et al. | 8/115.6 |
| 5,079,044 | 1/1992 | Schumacher et al. | 118/262 X |

FOREIGN PATENT DOCUMENTS

| | | | |
|---|---|---|---|
| 207336 | 1/1960 | Austria | 28/178 |
| 755182 | 2/1971 | France | 28/179 |
| 2057303 | 11/1979 | United Kingdom . | |

*Primary Examiner*—Clifford D. Crowder
*Assistant Examiner*—John J. Calvert
*Attorney, Agent, or Firm*—Anderson Kill Olick & Oshinsky

[57] ABSTRACT

Apparatus for sizing warps made of textile threads for the weaving process by application of a sizing liquor by means of rollers and subsequent removal of the excess liquor by roller conveyance through dehumidification—and drying zones, where following upon a preparation zone with an inlet guide roller at least one size application roller respectively facing the one or the other side of the warp is disposed, where the size application rollers are provided with sizing rollers motor driven with selection of the rpm and/or direction of rotation disposed slighty below the size application roller, this for observing the previously selected sizing application thickness, with the sizing rollers dipping with at least one-third of their circumference into the sizing liquor fed into tanks disposed beneath the size application rollers and where furthermore the rotational axes of the sizing rollers disposed beneath the size application rollers and the rotational axes on the size application rollers lie on a straight line connecting both axes, which straight line is inclined at 40° to 60° degrees with respect to the vertical, so that the wraparound angle of the warp around the size application rollers lies in the range between 60° and 90°.

9 Claims, 4 Drawing Sheets

APPARATUS FOR SIZING WARPS MADE OF TEXTILE THREADS

This is a divisional application of Ser. No. 07/891,899, filed Jun. 1, 1992, abandoned.

BACKGROUND OF THE INVENTION

The invention relates to an apparatus for sizing textile threads of warps. Apparatuses designed for performing sizing of textile threads have been known for many decades, and they serve to smooth the surface of these threads and for providing solidity for the weaving process. In the course of further development of the weaving process, principally by the increase in the number of picks, the requirements dealing with quality and strength of the warps were raised, and thus also the requirements dealing with the size application process. The throughput was increased from between 60 to 80 m/min to more than 160 m/min, the energy consumption increased from approximately 20 kW/h to above 100 kW/h, the steam consumption increased from approximately 500 kg/h to more than 1500 kg/h and the space requirements for installation from approximately 200 $m^3$ to more than 1200 $m^3$. Correspondingly the capital investment increased 5 to 8 times.

High pressure squeezing was introduced for increasing the output and improving the quality, and ever larger drying apparatus became necessary. However the application of the size (or liquor) proper remains essentially unchanged, namely to apply hot size of low concentration upon the warp by means of dipping- and squeezing-rollers then to dry this warp with a high energy expenditure. Herein one had to put up with thread hairiness unavoidably occurring always in the squeezing mechanism and in the drying part segment, in spite of the circumstance that it is part of the task of sizing to reduce the thread hairiness as fully as possible.

SUMMARY OF THE INVENTION

Proceeding from this unsatisfactory state of affairs, the inventor has now developed the task, of creating a sizing method and a sizing liquor, called size in the following for short, as well as an apparatus by means of which the overall energy consumption is to be reduced with the same or higher throughput and at the same time a better weaving efficiency is achieved by reduction of the thread hairiness and furthermore especially also the space requirement of the apparatus is to be made smaller. Another significant task be solved by the invention is especially to be viewed in developing and using a biologically degradable product which therefore would not be harmful to the environment.

This highly concentrated, pumpable, appliable, biologically degradable size with good adhesion, film elasticity and high resistance to wear developed in the invention is required for performing the method in the invention and is therefore a basic component of the teaching of the invention.

Proceeding from the known processes for sizing warps of textile threads for the weaving process through application of the sizing liquor by means of rollers and subsequent removal of the excess liquor by means of roller conveyance through dehumidifiers and drying zones, the method of the invention consists in that the warp is fed with selectable conveyance velocity $V_w$ in a preparatory zone by an inlet guide roller to a first size application roller for applying the low temperature size at a tangent to said roller and contacting same circumferentially to a limited extent; subsequently it is fed to a second size application roller disposed at the opposite side of the warp applying size also at a tangent to said roller and contacting same circumferentially to a limited extent on the warp rear side; and finally the warp passes through a drying region prior to being directed by an outlet guide roller to a take-up drum, warp beam or the like.

It is of essential significance in the method in the invention, that a size of starch- and/or protein derivatives is applied to the thread filaments of the warp in a concentration of 40% with adhesiveness increasing and/or viscosity controlling additives of gel-like, film-elastic consistency and having a thixotropic behavior, having a viscosity pasty at room temperature and pumpable and capable of being applied at a working temperature below 40° C., which size forms a protective film (protective colloid) around the filaments of the warp. Through cooperation of this sizing process and the application method as described and explained with particularity later, the warp threads are smoothed out better than by the known methods and are made to be particularly usable for weaving processes which have to satisfy high requirements.

Herein it is of significance that the low tempered size is applied on both sides of the warp with a coating of minimum thickness and is prepared for the take-up or reeling process in a small drying region. It is furthermore significant for the success of the method, that in the preparation zone of the warp the dust and other contamination particles adhering to this warp are removed by dust aspiration acting from both sides, and that furthermore the warp is wetted on both sides in a moistening zone of the preparation zone, wherein the wetting of the warp is preferably achieved by spraying both sides with finely divided spraying beams of a wetting liquid, or by vapor deposition, for instance with saturated steam. Other essential features of the invention consist in that size stored in a temperature-regulated manner is applied to the size application rollers in uniform application thickness of approximately 0.05 to 0.20 mm, wherein it is especially provided, that the uniform application thickness on the size application rollers is produced by dipping a portion of their circumference into the size kept ready in a container or reservoir at a temperature of 20° to 40° C.

The preparation of the warp by means of a cleaning- and suction process and the preparatory wetting is advantageous for the success of the method. This lowers the clinging tendency or even completely eliminates same and the wettability by the low temperature size is improved. Therefore the dust—and other contamination-particles are removed from the thread of the warp in an upstream preparation zone by blowing and suction from both sides, and it is furthermore provided that the warp be wetted from both sides in a moisturization zone preferably by vapor or steam deposition.

The procedure in the invention differs basically by the method steps from the known hot squeeze sizing, where a high apparatus and energy expenditure is required for heating the size and the sizing rollers as well as following thereupon for dehumidification, cooling and drying, and where cleaning occurs after sizing.

Further method peculiarities are additionally seen in that the size application rollers, motor-driven at a selectable rpm and direction of rotation, are acted upon by size of a uniform application thickness, whose temperature is regulated to between 20° and 40° C. During this it is advantageous if the size is applied with a selectable coating thickness to the size application rollers by means of a revolving sizing roller. Deviating from this it is also possible, that the sizing roller revolves driven by a dedicated motor 5 with selectable rpm and direction of rotation or is driven through a gear box by the roller motor and is held at a selective spacing from the size application roller or is slightly pressed against same.

It can be expedient herein that the size is kept continuously circulating by the line—and valve arrangement between the containers and the size storage reservoir, and that the fiber and dirt particles contained in the returning size are continuously filtered off.

A high degree of adaptability to the greatly variable nature of the threads and peculiarities of the weaving process is made possible by varying the circumferential velocity ($V_a$) of the size application roller while rotating in the same or opposite direction with observation of selected velocity difference relationships to the respectively momentary or real-time warp conveyance velocity ($V_w$) to correspond with the size application conditions with adaptation to the warp thread material to be processed. Herein it is also significant according to a method feature, that the size application coating be measured by sensors prior to feeding the warp into the drying zone. This measure permits to monitor the application process continuously and to control it by corrective intervention.

Since the size is applied in an essentially thinner coating at an essentially lower temperature than is usual in the state of the art, the energy expenditure for cooling and drying the warp can be kept within considerably tighter limits. Thus it is only necessary to pass the warp through a heated drying chamber in the drying region for this purpose. The heating can occur by high frequency or infrared heating; however freeze-drying methods can also be used or it is possible to guide the warp through heated contact-drying cylinders in the drying zone.

Measuring devices for monitoring and influencing the control of the working velocity of the process sequence are also essential for controlling same. Tension-measuring rollers are provided for this purpose, and to be sure at least in the preparation zone as well as upstream of the transfer into the take-up or reeling region. Apart from this it could also be expedient to provide additional tension-measuring devices between the individual processing segments. The thread tension of the warp important for the application process can be monitored or controlled by these measurement results, in order to maintain the nominal velocity provided for the specific properties of the warp to which size has to be applied. This velocity is imparted to the warp by a drive roller, around which roller the warp is conducted with a wraparound angle of at least 250°. It can also be provided that the warp is conducted around at least one contact drying cylinder with a wraparound angle of at least 220° for producing the conveyance velocity ($V_w$). It is also possible to utilize two or several drive rollers, whose rpms are however continuously matched to each other by an automatic control system based upon the tension measurement.

A basically advantageous process or method portion which has already been mentioned previously is to be seen in that starch- and/or protein derivatives in a concentration exceeding 40% with adhesiveness enhancing and/or viscosity-controlling additives of gel-like, film elastic consistency having thixotropic behavior and of a viscosity which is pasty at room temperature and pumpable and appliable at a working temperature below 40° C. is applied as sizing upon the threads of the warp. By applying a highly concentrated size at low temperature, which can be heated with a lower energy expenditure than is required with conventional hot sizes, less size has to be processed, in order to apply the same quantity of size substance upon the warp and there results herefrom a considerable reduction of the energy expended for the subsequent drying of the warp. Furthermore an improved adhesion of the size to the warp is achieved at room temperature and in addition it is more friendly to the environment.

Finally it is possible to achieve a high throughput velocity ($V_w$) of the warp precisely because of the reduced drying requirements.

The expedient design of the apparatus for performing the method in the invention consists in providing a preparation zone downstream of at least one inlet guide roller and adjoining thereto at least one size application roller facing respectively one or the other side of the warp and downstream thereof a drying zone as well as an outlet guide roller.

In an expedient refinement a cleaning device acting from both sides upon the warp is disposed within the preparation zone, where the dust- and other contamination-particles adhering in and at the warp are extracted and thus do not penetrate into the installation and the process especially not into the size. An expedient refinement can consist of having the cleaning device comprise at least two blowing- and suction-appliances oppositely located or offset on both sides, provided with filtering devices exerting a variably strong suction draft upon the warp conducted in between them.

It is proposed by way of an additional advantageous feature, to provide at least one wetting zone within the preparatory zone, comprising spraying devices disposed on both sides of the warp, which spray a moistening liquid or saturated steam.

Furthermore the apparatus provides that size application rollers are disposed which are fed temperature regulated size, and that the size is maintained in circulation through a line- and valve arrangement centrally controlled and conveyed by pumps connected to a storage reservoir and filtering devices; furthermore a motor-driven stirring mechanism and a filter arrangement with replaceable filter inserts can be provided in the storage reservoir. In this way the size can be held ready for application by means of size application rollers and a film formation is prevented. Furthermore the fibers or dirt particles separated from the warp during application of the size are continuously filtered out of the size liquor, whereby a very uniform composition and constant processing properties of the size are achievable.

An advantageous design provides in addition that the axes of rotation of the size rollers disposed beneath the size application rollers and the axes of rotation of the size application rollers lie on a straight line connecting both axes with this straight line forming an angle of 40° to 60° with the vertical; in addition the aperture of a feed line for the size is disposed in the region of the gap- or squeezing joint between the two rollers and that a drip or drainage tank with an aperture for connecting the outlet Line for the size is provided.

According to an additional feature the outer wall of the size drainage tank facing the warp can extend at an angle with respect to the vertical, which has an inclination between angles of approximately 20° to 50° formed between the warp and that of the straight line, furthermore it is advantageous if the wraparound angle of the warp around the size application rollers lies in the range between 60° and 90°.

It can also be provided advantageously, that the traveling direction of the warp after having passed the inlet guide rollers is oriented upwards at a right- or obtuse-angle and that the preparation zone with its equipment is disposed above the inlet guide rollers, furthermore that the size application rollers are disposed above the inlet or the preparation zone with the drying region being arranged above the size application rollers. In this connection it is advantageous if the warp is subjected at least once to a travel direction reversal within the drying region being deviated out of its travel direction upwards and partially embracing a reversing roller, or that the travel direction of the warp after leaving the drying region is directed downwards and guided through outlet guide rollers to the take-up or reeling region. By this three-dimensional superimposed arrangement it is possible to achieve considerable advantages by reducing the floor area occupied by the apparatus and consequently reducing the investment capital.

BRIEF DESCRIPTION OF THE DRAWINGS

The following embodiment examples of the invention show advantageous features and peculiarities which are explained and described in the following with particularity with the help of the illustrations in the drawings, wherein.

DETAILED DESCRIPTION OF THE PREFERRED EMBODIMENT

Figure 1:
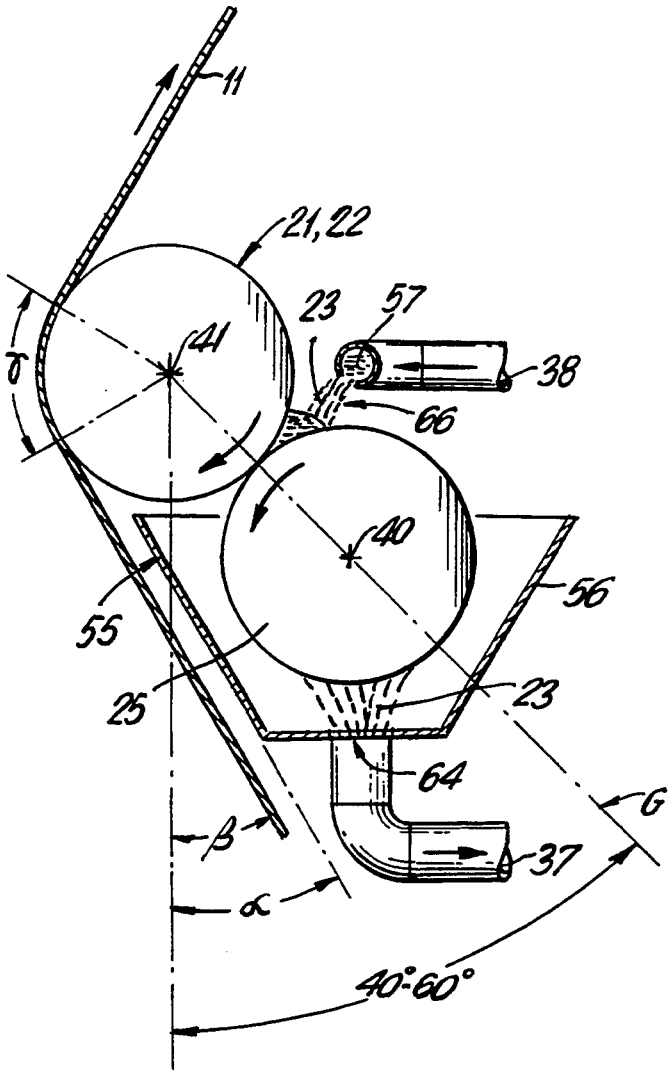
FIG. 1 a size application by means of a size application arrangement.

FIG. 1 shows the size application with one size application roller 21, 22 for each warp side 10, 11. The warp 10 is passed by the size application roller 21, 22 with a velocity of $V_w$. The size application rollers 21 and 22 are driven at selectably changeable circumferential velocities $V_a$ and directions of rotation. The threads of the warp absorb herein the size 23 from the size application rollers 21, 22.

The size application rollers 21, 22 can dip with their bottom side into the size 23 kept ready for use in a manner not shown here.

The size application rollers 21, 22 take up the size in the course of their revolutions, and the excess size can be brought to the desired application thickness by means of doctor strip or doctor roller which is not shown here.

FIG. 1 shows the preferred embodiment of the size application, where the size 23 is applied with size application roller 21, 22 by means of the rolling size roller 25.

The axes of rotation 40 and 41 of the sizing rollers and the size application rollers 21, 22 lie on a straight Line G, which in the embodiment example forms an angle of approximately 45° with the vertical. By this oblique positioning of the size roller 25 with respect to the size application roller located above, it is made possible that the container 56 can also be shifted away from the size application roller 21, 22 and with this also from the warp 11 and thus the wraparound angle 7 of the warp web around this roller can be increased. The warp web is directed to the size application rollers 21, 22 at an angle of inclination $\alpha$ to a vertical, which passes through the axis 41 of the size application roller. The side wall of the container 56 extends to that vertical at an angle $\beta$, which is greater than $\alpha$.

In this embodiment the size roller 25 does not dip into a reservoir containing size, rather the size is fed through the line 38, whose mouth 57 is directed to the gap- or the squeezing-joint 66, which is formed between the size application rollers 21, 22 and the size rollers 25. The excess size 23 drips or drains now into the size drainage container 56 and is removed through the outlet aperture 64 and the line 37.

Figure 2:
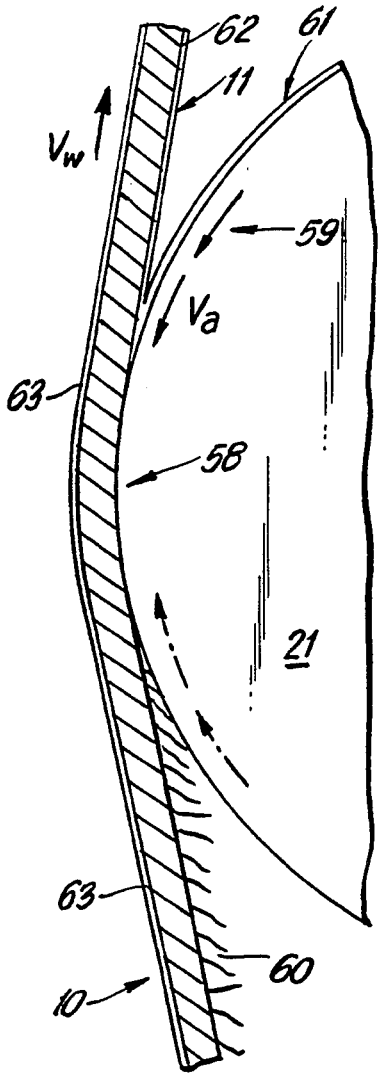
FIG. 2 a detail of FIG. 1.

A detail of FIG. 1 is shown in FIG. 2, showing how the warp 10 which already has a size coating 63 on one side applied in the course of a previous sizing is conducted with its back side 11 past the size application roller 21 and is provided in the application region 59 with size 23 contained in a sizing film 61 on the size application roller 21. In the course of this process however not only does the process of the rear side size application 62 occur in the application region 39, rather the warp 10 is smoothed out in the smoothing region 58 so that fibers 60 no longer protrude after the sizing.

Figure 3:
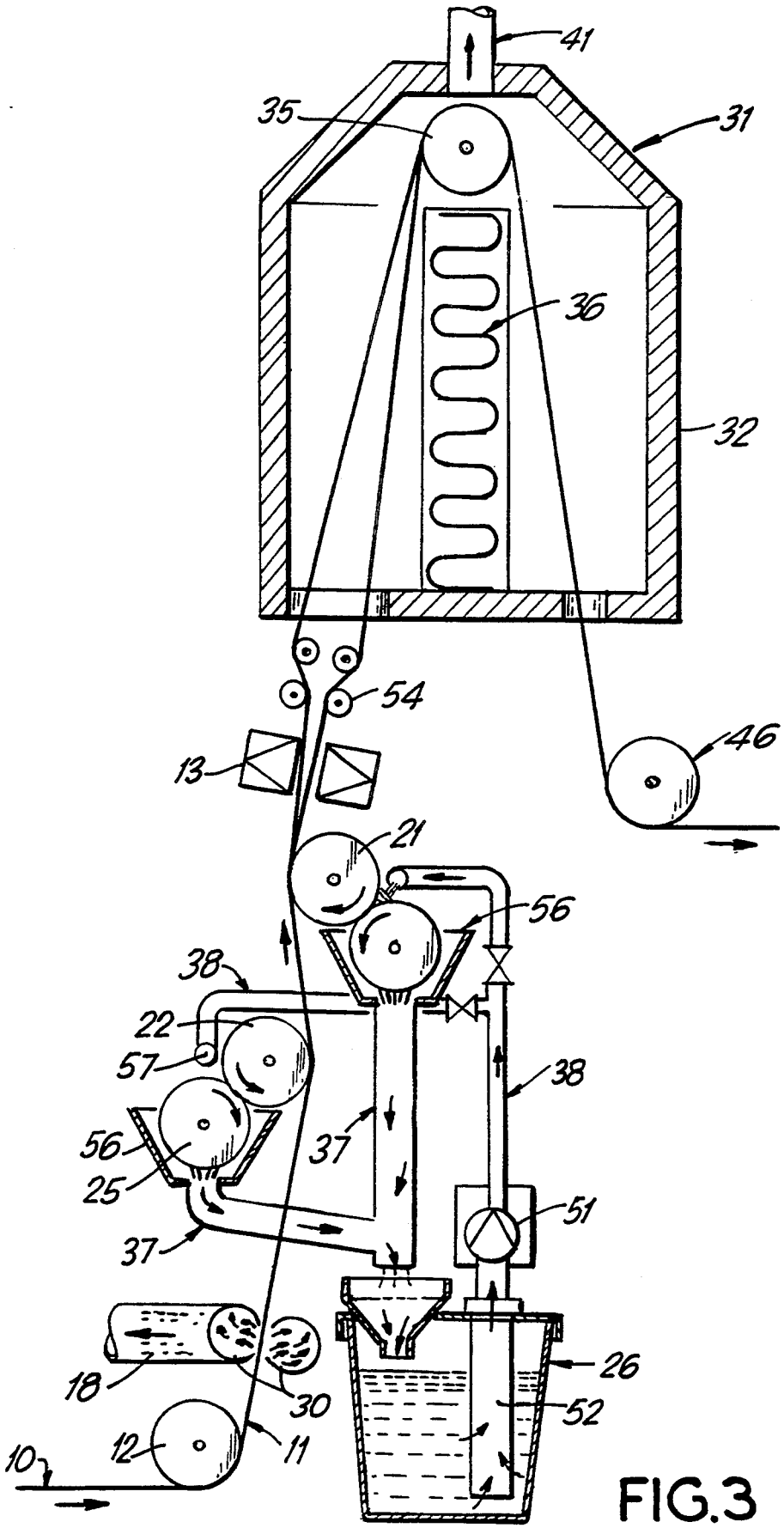
FIG. 3 a process sequence diagram and an apparatus the invention.

FIG. 3 illustrates the diagram of a sizing process in the invention and the pertaining apparatus parts. The warp 10 runs from a take-off device not shown here through an inlet guide roller 12, which changes the travel direction upwards, into a preparation zone, where fiber- and dirt-particles are removed from both sides of the wall 10 by means of blowing and suction heads 30 of a cleaning device 18, which are arranged opposite each other for removing dust away. Thereupon said warp can be wetted with a moisturizing agent or steam in the wetting zone. Subsequently the warp 10, 11 passes through stations arranged on opposite sides one above the other, where the threads receive a coating of size 23 from respectively one or the other side by means of size application rollers 21, 22 as is illustrated in FIGS. 1 and 2. The size 23 is kept available at a temperature regulated by heating; it is fed through replenishing lines 38 by means of a conveyor pump 51 and drains through outlet lines 37. The feed and return lines 38, 37 are connected to a size storage reservoir 26 which is also heated and can include a stirring mechanism. In addition it is provided with replaceable filter arrangements 52 for filtering the size 23.

After having passed the size application rollers 21, 22 the warp arrives into the measuring region 13 where it is monitored. In this embodiment example an additional motor-driven smoothing device 54 with simultaneous wet splitting is disposed upstream of the inlet into the drying region 31. The drying zone 31 is in this case designed as contactless drying in a drying chamber 32 heated by a dryer heater 36, in which chamber the warp 10 is conducted over a reversing roller 35.

After the drying process the warp 10 is directed through an outlet guide roller 46 to a take-up or reeling region, not shown here.

Figure 4:
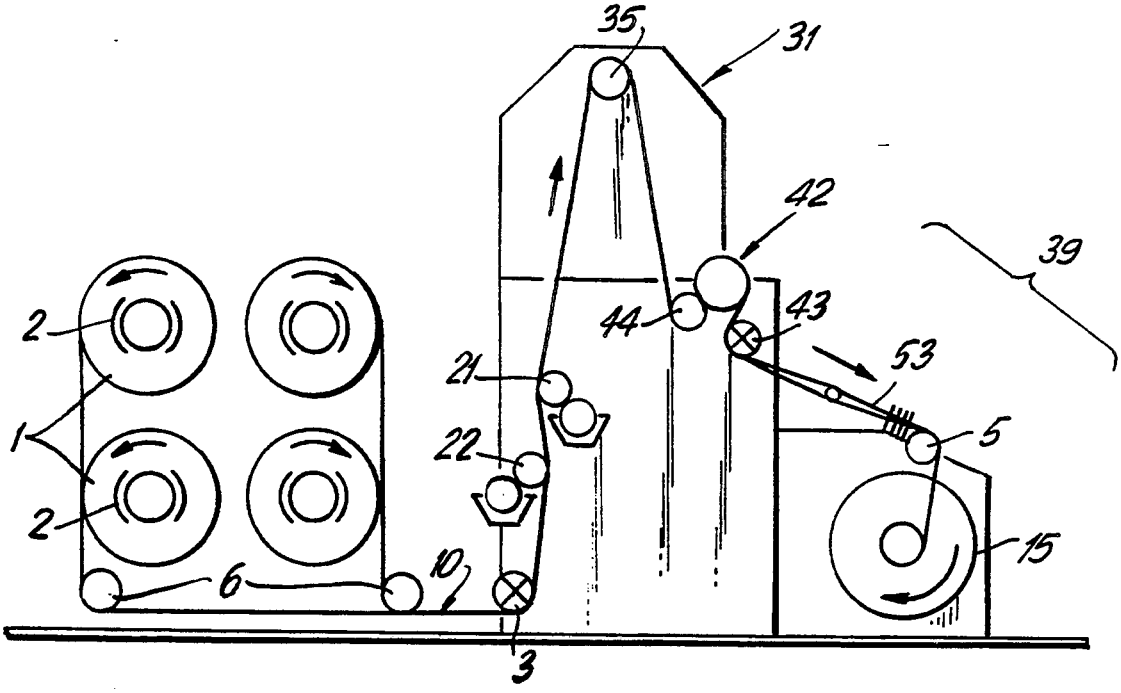
FIG. 4 a sizing apparatus with contactless drying.

FIG. 4 shows a sizing apparatus assembly with contactless drying. The warp 10 is reeled off warp rollers 1 by means of guide rollers 6, which are braked by means of brakes 2 in such a way, that the tensile stress of the warp 10 measured by the tension measuring rollers 3 maintains a specific value. The warp 10 is redirected upwards at the tension measuring roller 3 which serves as an inlet guide roller 12 and is fed to superimposed size application rollers 21, 22 for applying size to both sides. The warp 10 is passed through the drying region 31 by the size application rollers 21, 22, being diverted downwards by a reversing roller 35, and fed by a roller 44 to the drive roller 42 constituting the guidance drive. Subsequently the warp 10 arrives into the take-up or reel-up region 39 over a tension measuring end roller 43, which can also serve as outlet guide roller 46, in which region 39 it is directed to the warp beam 15 or a take-off or reel-up drum through a splitting device 53 and a reversing roller 5. The drive of the warp beam 15 is regulated in such a way, that the tensile stress measured by the tension-measuring end roller 43 maintains a specific value; the drives of the size application rollers 21, 22 are regulated by the drive roller 42.

Figure 5:
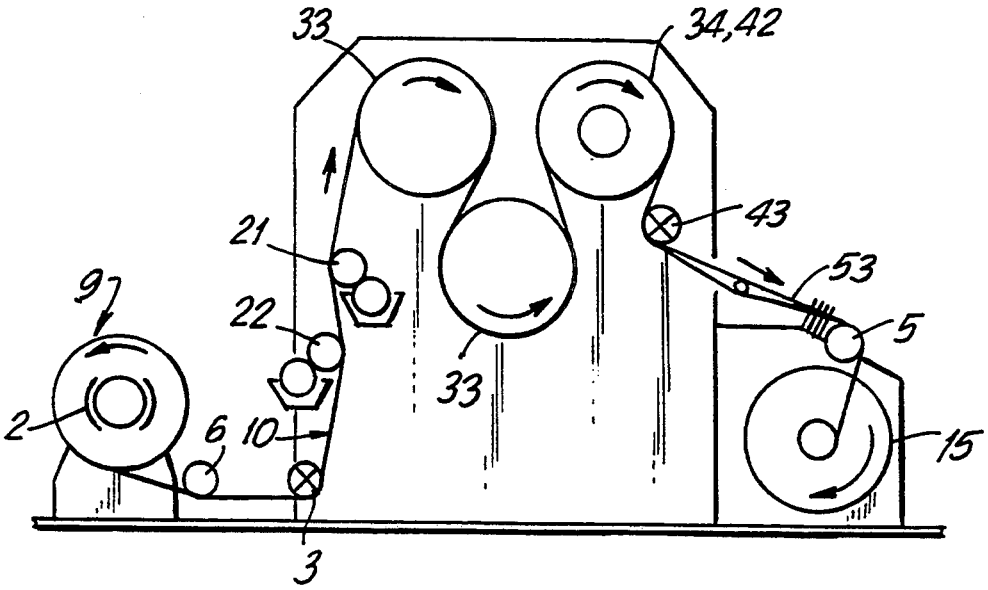
FIG. 5 a sizing apparatus with contact dryer.

FIG. 5 shows a sizing apparatus with contact drying. The warp 10 is taken off a warping drum 9 by guide rollers 6 and arrives through the tension measuring roller 3 at the size application rollers 21, 22. The drying process occurs in the drying cylinder 33, 34 wherein one drying cylinder 34 serves as drive roller 42. The rest of the arrangement corresponds to that in FIG. 6.

Figure 6:
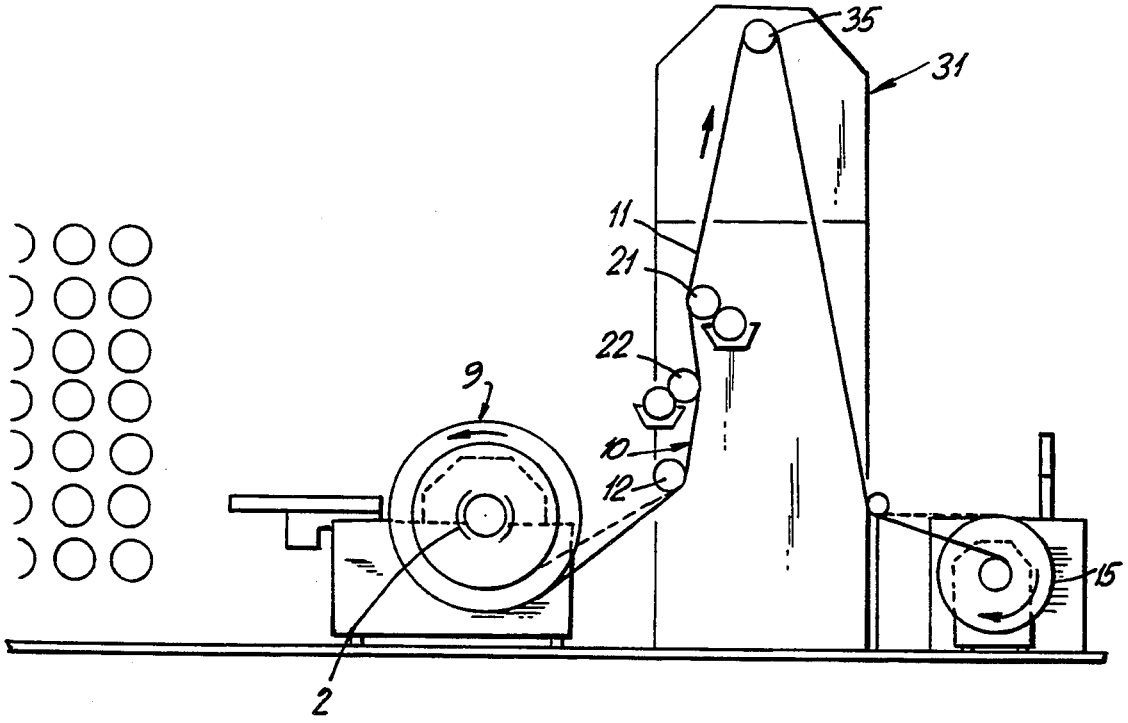
FIG. 6 a sizing apparatus in connection with a warping drum.

FIG. 6 shows a sizing apparatus, where the warp 10 is taken off a warping cylinder 9 provided with a brake 2, which cylinder also serves as take-off cylinder and is fed to the apparatus. It arrives over the inlet guide roller 12 to the size application roller 21, 22 arranged on top of the guide roller and then into said drying region 31. The warp 10 is conducted over a tension measuring end roller 43 and is fed over a reversing roller 5 to the take-up or reeling drum warp beam 15.

I claim:

1. An apparatus for sizing warps made of textile threads by application of a liquor size, said apparatus comprising:

means for sizing opposite sides of a warp and including first and second size application rollers, arranged on opposite sides of a warp path in a spaced relationship in a travel direction of the warp, for applying a size to the opposite sides of the warp;

drive means for moving the warp past said first and second size application rollers;

first guide means located upstream of said sizing means for advancing the warp tangentially to said first size application roller, said second size application roller being so arranged relative to said first size application roller that the warp is also advanced tangentially to said second size application roller;

second guide means located downstream of said sizing means for advancing the warp to a take-up station;

means located downstream of said sizing means and upstream of said second guide means for drying the size on the opposite sides of the warp;

wherein said first guide means comprises an inlet guide roller, and said second guide means comprises an outlet guide roller; and wherein said apparatus further comprises at least one device for cleaning the opposite sides of the warp and located downstream of said inlet guide roller and upstream of said sizing means.

2. An apparatus as set forth in claim 1, wherein said first guide means comprises an inlet guide roller, and said second guide means comprises an outlet guide roller.

3. An apparatus as set forth in claim 1, wherein said cleaning device comprises two blowing and suction heads located on the opposite sides of the warp path.

4. An apparatus as set forth in claim 1, further comprising first and second size rollers for applying the size to said first and second size application rollers, respectively; first and second feed lines for feeding the size to said first and second size application rollers, each of said feed lines having an outlet aperture opening into a gap between respective one of said first and second size application rollers and a respective one of said first and second size rollers; and first and second drainage containers associated with said first and second size rollers and having each an outlet for draining excess size.

5. An apparatus as set forth in claim 1, wherein a wrap around angle of the warp around each of said first and second size application rollers is in a range of about 60°-90°.

6. An apparatus as set forth in claim 1, further comprising roller means for reversing at least once a travel direction of the wrap within a region of said drying means.

7. An apparatus as set forth in claim 6, wherein said roller means provides for movement of the wrap downward after the wrap leaves the region of said drying means.

8. An apparatus for sizing warps made of textile threads by application of a liquor size, said apparatus comprising:

means for sizing opposite sides of a warp and including first and second size application rollers, arranged on opposite sides of a warp path in a spaced relationship in a travel direction of the warp, for applying a size to the opposite sides of the warp;

drive means for moving the warp past said first and second size application rollers;

first guide means located upstream of said sizing means for advancing the warp tangentially to said first size application roller, said second size application roller being so arranged relative to said first size application roller that the warp is also advanced tangentially to said second size application roller;

second guide means located downstream of said sizing means for advancing the warp to a take-up station;

means located downstream of said sizing means and upstream of said second guide means for drying the size on the opposite sides of the warp;

first and second size rollers for applying the size to said first and second size application rollers, respectively;

first and second feed lines for feeding the size to said first and second size application rollers, each of said feed lines having an outlet aperture opening into a gap between respective one of said first and second size application rollers and a respective one of said first and second size rollers; and first and second drainage containers associated with said first and second size rollers and having each an outlet for draining excess size;

wherein a straight line, which connects axis of a respective pair of said first and second size application rollers and said first and second size rollers, extends to a vertical at an angle from 40° to 60°; and wherein a side wall of each of said first and second drainage container, which faces the wrap, extends substantially parallel to the wrap and at an angle to the vertical, which is greater than an inclination angle of the wrap and which is located within the angle at which said straight line extends to the vertical.

9. An apparatus as set forth in claim 8, wherein the inclination angle of the wrap is in a range of about 20°–50°, and a wrap-around angle of the wrap around each of the first and second size application rollers is in a range of about 60°–90°.

* * * * *

UNITED STATES PATENT AND TRADEMARK OFFICE

CERTIFICATE OF CORRECTION

PATENT NO. : 5,381,593

DATED : January 17, 1995

INVENTOR(S) : Joachim Bloch

It is certified that error appears in the above-indentified patent and that said Letters Patent is hereby corrected as shown below:

On the title page, item [21] should read --Appl. No.: 114,414--.

Signed and Sealed this

Eleventh Day of April, 1995

*Attest:*

Bruce Lehman

BRUCE LEHMAN

*Attesting Officer*

*Commissioner of Patents and Trademarks*